US009157441B2

(12) United States Patent
Dickinson et al.

(10) Patent No.: US 9,157,441 B2
(45) Date of Patent: Oct. 13, 2015

(54) DOUBLE INLET CENTRIFUGAL BLOWER WITH PERIPHERAL MOTOR

(75) Inventors: Roger Dickinson, Torrington, CT (US); Robert A. Hoyt, Bristol, CT (US)

(73) Assignee: Henkel IP & Holding GmbH, Düsseldorf (DE)

( * ) Notice: Subject to any disclaimer, the term of this patent is extended or adjusted under 35 U.S.C. 154(b) by 922 days.

(21) Appl. No.: 13/277,269

(22) Filed: Oct. 20, 2011

(65) Prior Publication Data

US 2013/0101449 A1 Apr. 25, 2013

(51) Int. Cl.

| | |
|---|---|
| ***F04D 17/00*** | (2006.01) |
| ***F04D 17/16*** | (2006.01) |
| ***F04D 25/06*** | (2006.01) |

(52) U.S. Cl.

CPC ..... *F04D 17/162* (2013.01); *F04D 25/0606* (2013.01)

(58) Field of Classification Search

CPC ..... F04D 17/162; F04D 25/0606
USPC ..... 417/423.7, 423.1, 350; 415/101–102, 415/93, 97–98

See application file for complete search history.

(56) References Cited

U.S. PATENT DOCUMENTS

| | | | |
|---|---|---|---|
| 2,776,088 | A | 10/1957 | Wentling |
| 3,231,176 | A | 1/1966 | Bowen |
| 3,480,202 | A | 11/1969 | Stephenson, Jr. |
| 3,775,029 | A | 11/1973 | Ranz |
| 5,257,904 | A | 11/1993 | Sullivan |
| 5,570,996 | A | 11/1996 | Smiley, III |
| 5,592,059 | A | 1/1997 | Archer |
| 6,030,173 | A | 2/2000 | Bacchiocchi |
| 6,076,795 | A | 6/2000 | Scheidel |
| 7,112,910 | B2 | 9/2006 | Lopatinsky et al. |
| 7,167,364 | B2 | 1/2007 | Lopatinsky et al. |
| 8,100,637 | B2 | 1/2012 | Sinzaki |
| 2005/0140233 | A1 | 6/2005 | Kojima et al. |
| 2008/0001488 | A1 | 1/2008 | Pythonen et al. |
| 2009/0114206 | A1 | 5/2009 | Post |
| 2010/0044468 | A1 | 2/2010 | Granger et al. |
| 2010/0089090 | A1 | 4/2010 | Kim et al. |
| 2010/0226802 | A1* | 9/2010 | Kawamura et al. ..... 417/423.7 |

(Continued)

FOREIGN PATENT DOCUMENTS

| | | |
|---|---|---|
| CN | 2627252 | 7/2004 |
| GB | 140664 | 4/1920 |
| GB | 733533 | 7/1955 |

(Continued)

OTHER PUBLICATIONS

Torin Airflow Management, Direct Drive Blowers (Oct. 2004), www.torin.com. au/PDF/04_TorinDirectDriveBlowers_201110.pdf.
FASCO, Stock Replacement Catalogue, p. 60-65. (2008) www.fasco.com/prodcat.asp.

*Primary Examiner* — Charles Freay
*Assistant Examiner* — Christopher Bobish
(74) *Attorney, Agent, or Firm* — Haugen Law Firm PLLP

(57) ABSTRACT

A centrifugal blower apparatus includes a scroll-shaped housing with first and second air inlets which open to a blower chamber that is in fluid communication with an air outlet. The blower includes a motor to drive an impeller, wherein the motor is secured to a frame that is coupled with the housing in a manner to substantially enhance aerodynamic performance of the blower.

20 Claims, 7 Drawing Sheets

(56) References Cited

U.S. PATENT DOCUMENTS

| | | | | |
|---|---|---|---|---|
| 2011/0243720 | A1 | 10/2011 | Post | |
| 2013/0216410 | A1 * | 8/2013 | Patterson et al. | 417/420 |

FOREIGN PATENT DOCUMENTS

| | | |
|---|---|---|
| KR | 20070050155 | 5/2007 |
| WO | 2012012547 | 1/2012 |

* cited by examiner

DOUBLE INLET CENTRIFUGAL BLOWER WITH PERIPHERAL MOTOR

FIELD OF THE INVENTION

The present invention relates to centrifugal blowers generally, and more particularly to a double inlet centrifugal blower with an integrated drive motor that minimizes interference with air flow dynamics through the blower to enhance efficiency and reduce acoustic level.

BACKGROUND OF THE INVENTION

Demands for electronic equipment to increasingly provide higher-performance operation in smaller packages are ever present. Typically, such electronic equipment requires compact and highly efficient cooling systems to provide cooling air to power supplies, microprocessors, and related electronics that reside in the equipment. A typical cooling system involves moving air across one or more operating electronic components, such as printed circuit boards. The flow path layout, type of air moving device, and how well it is integrated into the system are each key elements in achieving desired cooling performance in a small package size.

Air movers of various type are available to select from in designing an electronics package cooling system. Such air mover types include axial fans and centrifugal blowers, which each exhibit advantages and disadvantages. Conventional systems, however, often employ fans and blowers that are not well matched to the system pressures, or do not move air efficiently within the space constraints, and therefore result in unacceptable noise and relatively large power consumption.

A particularly useful type of air mover is a double inlet centrifugal blower. Such blowers may be particularly well suited for restrictive flow systems that require a high volume of cooling air. Conventional implementations of centrifugal blowers typically employ a motor that is affixed in one of the two inlets, or inside the hub of the blower wheel with strut connections at one or both of the inlets. Neither conventional design is optimal, due to the motor occupying valuable aerodynamic space, which reduces the overall cooling efficiency of the blower, and creates unwanted noise. The hub motor approach also requires a hollow shaft and resultant manufacturing complexities associated with routing stator wires through a mounting shaft. An example conventional arrangement in which the motor is mounted in one of the two inlets of the centrifugal blower is that available from Fasco as model number B45267. An example of a double inlet centrifugal blower with a hub motor with a strut assembly for securing the motor inside of the hub is described in U.S. Pat. No. 2,776,088 to Wentling.

An alternate approach employs a mid-plane blower motor of the type described in U.S. Pat. No. 3,231,176 to Bowen. While the arrangement described in the Bowen '176 patent reduces the obstruction in the impeller volume, such design nevertheless employs struts for rotor support in the housing inlets. Such struts, as described above, inhibit aerodynamic efficiency.

It is therefore an object of the present invention to provide a double inlet centrifugal blower employing a strutless motor which minimizes aerodynamic interference and simplifies construction. In doing so, such a blower enhances operating efficiency to potentially reduce power consumption and noise output.

SUMMARY OF THE INVENTION

By means of the present invention, the operating efficiency of a double inlet centrifugal blower may be significantly enhanced while simultaneously reducing noise output. Moreover, the arrangement of the present invention reduces manufacturing costs, and simplifies assembly.

In one embodiment, a centrifugal blower apparatus of the present invention includes a housing having a first scroll-shaped side with a first air inlet, and a second scroll-shaped side with a second air inlet, wherein the first and second air inlets open to a blower chamber that is in fluid communication with an air outlet of the housing. The blower apparatus further includes an operating system having a frame that is arranged in the blower chamber between the first and second sides, and a motor or motor components secured to the frame. The frame with motor or motor components includes a hub defining a blower axis, a rotor that is rotatably driven about the blower axis, and a stator. The rotor includes a rotor core with a rotor element annularly arranged about the hub, and a first impeller portion including impeller blades for motivating air out from the blower chamber through the air outlet. The stator is annularly arranged radially outwardly about the rotor element. The operating system is coupled with the housing only at a coupling location that is downstream from the impeller portion.

In another embodiment, the centrifugal blower apparatus of the present invention includes a housing having first and second scroll-shaped sides separated by a main body portion defining an air outlet, wherein the first side has a first air inlet, and the second side includes a second air inlet. The first and second air inlets open to a blower chamber that is in fluid communication with the air outlet. The main body portion of the housing defines a midportion axially substantially midway between the first and second sides. The blower apparatus further includes an operating system having a frame arranged in the blower chamber between the first and second sides, a first impeller for motivating air out from the blower chamber through the air outlet, and a motor for rotating the first impeller in a first circumaxial direction about a hub defining a blower axis. The motor has a rotor coupled to the first impeller circumaxially about the hub, with a rotor diameter substantially equal to a first diameter of the first impeller, and an annular stator arranged radially outwardly about the rotor. The rotor and stator are secured to the frame within the blower chamber. The operating system is coupled with the housing only at a coupling location downstream from the first impeller.

DETAILED DESCRIPTION OF THE PREFERRED EMBODIMENTS

The objects and advantages enumerated above together with other objects, features, and advances represented by the present invention will now be presented in terms of detailed embodiments described with reference to the attached drawing figures which are representative of various possible configurations of the invention. Other embodiments and aspects of the invention are recognized as being within the grasp of those having ordinary skill in the art.

Figure 1:
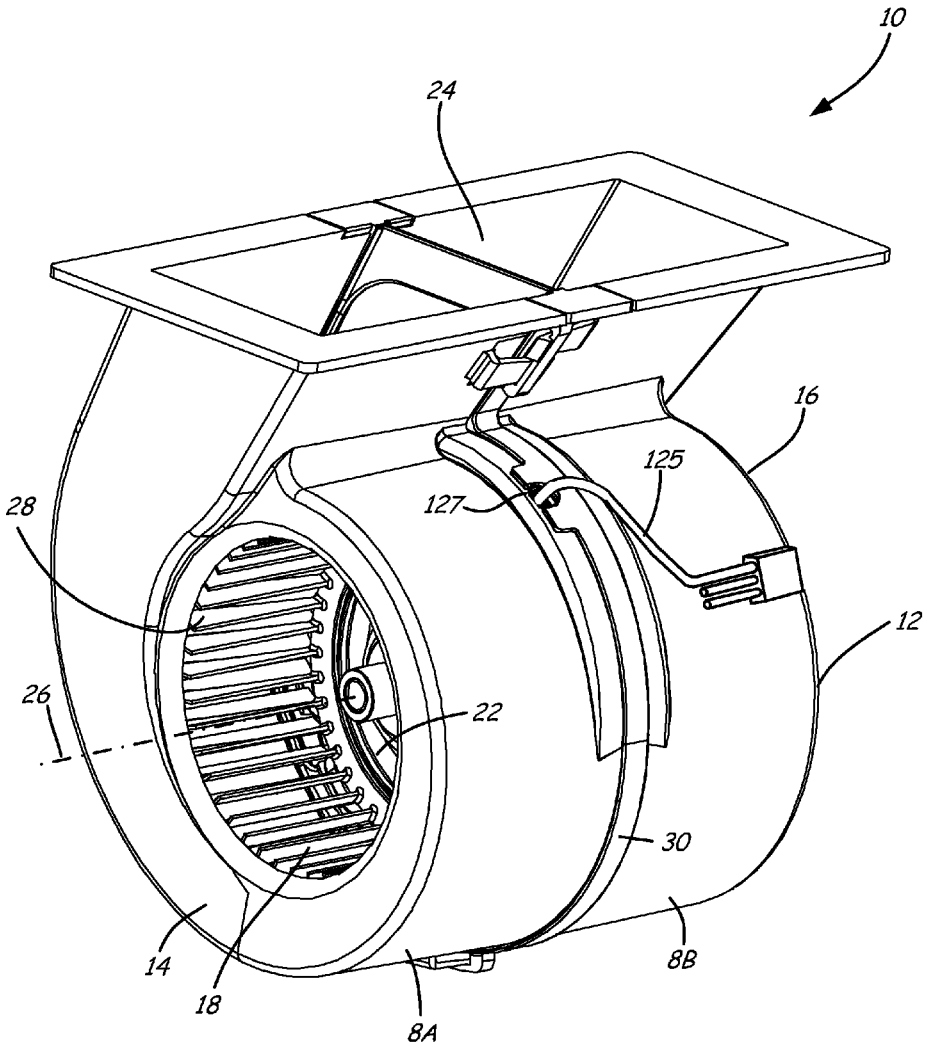
FIG. 1 is a perspective view of a centrifugal blower of the present invention.
Figure 2:
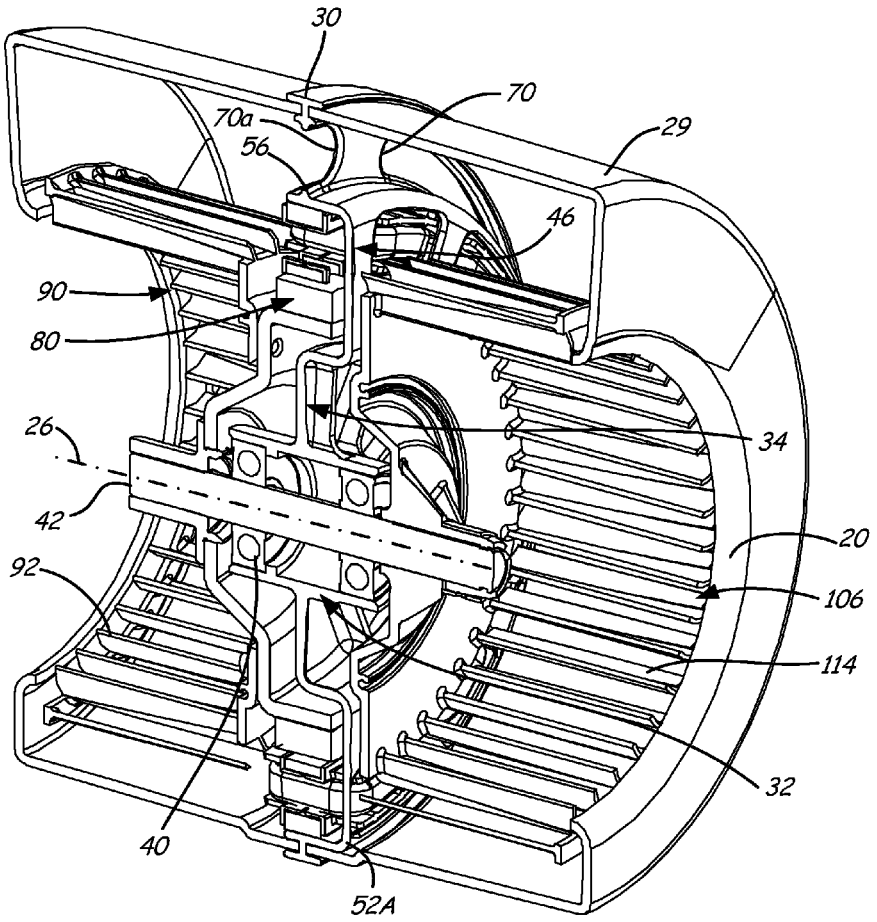
FIG. 2 is a cross-sectional perspective view of the blower illustrated in FIG. 3.

With reference now to the drawings, and first to FIG. 2, a centrifugal blower apparatus 10 includes a housing 12 having a first scroll-shaped side 14 with a first air inlet 18, and a second scroll-shaped side 16 with a second air inlet 20. First and second air inlets 18, 20 open to a blower chamber 22 that is in fluid communication with an air outlet 24 of housing 12. It is contemplated that housing 12 may be configured as needed, including in a generally conventional configuration employing an expanding scroll-shape in the output air flow portion of housing 12.

Blower apparatus 10 may preferably be a centrifugal blower in which air flow into first and second inlets 18, 20 substantially parallel to a blower axis 26 may be re-directed radially of blower axis 26 by an impeller 28 rotating about blower axis 26. In a particular embodiment, blower apparatus 10 may be a "double-inlet" centrifugal blower employing first and second inlets 18, 20 at opposed first and second sides 14, 16. Moreover, blower apparatus 10 may be a double width, double inlet (DWDI) blower of the type illustrated. As indicated above, certain applications favor the utilization of a centrifugal blower, and may, in some cases, preferably employ a double inlet centrifugal blower.

The illustrated embodiment of housing 12 employs first and second housing sections 8A, 8B which are secured together at a coupling location 30, as will be described in greater detail hereinbelow. The coupling of first and second housing sections 8A, 8B establishes blowing chamber 22 and a defined air outlet 24. It is to be understood, however, that housing 12 may be fabricated in one or more sections/pieces, and may be assembled in a manner suitable for the desired application. In the illustrated embodiment, first and second housing sections 8A, 8B are substantially minor images securable at coupling location 30, which may be substantially mid-way between first and second sides 14, 16. Coupling location 30 may therefore be disposed at a midportion 33 of housing 12. It is to be understood that housing 12 may be fabricated from a variety of materials encompassing numerous physical properties. Housing 12 may therefore be fabricated from metals, plastics, composites, ceramics, and the like.

An operating system or subassembly 32 includes the rotating and stationary components of the air moving equipment of blower apparatus 10 in a manner that is substantially less aerodynamically intrusive than conventional approaches. Moreover, operating system 32 facilitates precise and stable support of moving components relative to stationary components, thereby allowing close operating clearances and higher motor efficiencies to compliment the aerodynamic efficiency described above.

Operating system 32 includes a frame 34 that is arranged in blower chamber 22 between first and second sides 14, 16. Frame 34 may be a unitary cast member or an assembly which provides the structural support of blower apparatus 10. Consequently, frame 34 is preferably sufficiently strong to stably support the remaining components of blower apparatus 10 is precise and stable relative operating positions. A consequence of such stability is the opportunity for fabricator to minimize component separation clearances to further enhance the operating efficiencies of blower apparatus 10. Frame 34 may therefore be fabricated from a strong and relatively rigid material such as appropriate metals, plastics, composites, and ceramics. In one embodiment, frame 34 is a unitary cast body that is cast as a single piece from aluminum, or may be an injection molded engineered plastic.

In the illustrated embodiment, frame 34 includes a bearing housing portion 36 that may be integrally formed with frame 34 to form a bearing chamber 38 in which one or more bearings 40, such as ring bearings, may be operably positioned. Such bearings 40 rotatably support a shaft 42 within a hub 44. Shaft 42 is therefore arranged in hub 44 to rotate about blower axis 26. Shaft 42 is therefore rotatably secured to frame 34 through one or more bearings 40, which are themselves secured in bearing chamber 38 defined by bearing housing portion 36 of frame 34.

Frame 34 may include a stator support portion 46 that extends radially outwardly from central portion 48 of frame 34. In some embodiments, central portion 48 is coextensive with a midplane 50 that extends substantially perpendicularly to blower axis 26 through midportion 33 of housing 12. Stator support portion 46 of frame 34 may include an upright portion 52 axially offset from central portion 48 to form a mounting pocket 54 between central portion 48, upright portion 52, and upper brace portion 56 of frame 34. Upper brace portion 56 may extend from upright portion 52 in a direction substantially parallel to blower axis 26, and may further include a strengthening rib 58 for strengthening and inhibiting deflection of upper brace portion 56 in the operation of blower apparatus 10. The extent of axial displacement of upright portion 52 from central portion 48 of frame 34 may preferably be sufficient to define a mounting pocket 54 of adequate axial width to facilitate mounting of rotor and stator elements substantially along midplane 50. It is contemplated, however, that frame 34 may be provided in a configuration without mounting pocket 54, with the illustrated embodiment defining merely an exemplary embodiment of the present invention.

Upright portion 52 of frame 34 may be substantially disk-shaped, or may instead be defined by a plurality of circumaxially spaced-apart upright members extending radially between central portion 48 and upper brace portion 56 of frame 34, and arranged annularly about blower axis 26. Upright portion 52 created through a plurality of upright members 52*a* may be an advantageous design for cost savings, weight savings, and aerodynamic benefits.

Figure 3:
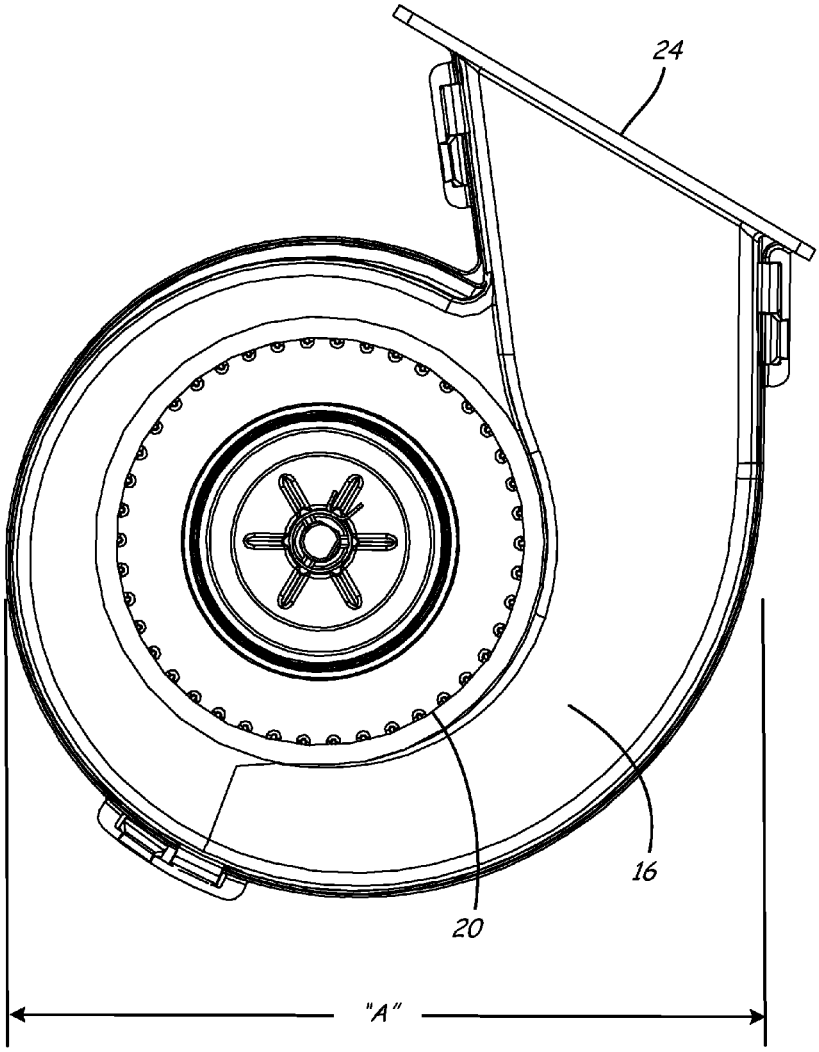
FIG. 3 is a side elevational view of the blower illustrated in FIGS. 1 and 2.
Figure 4:
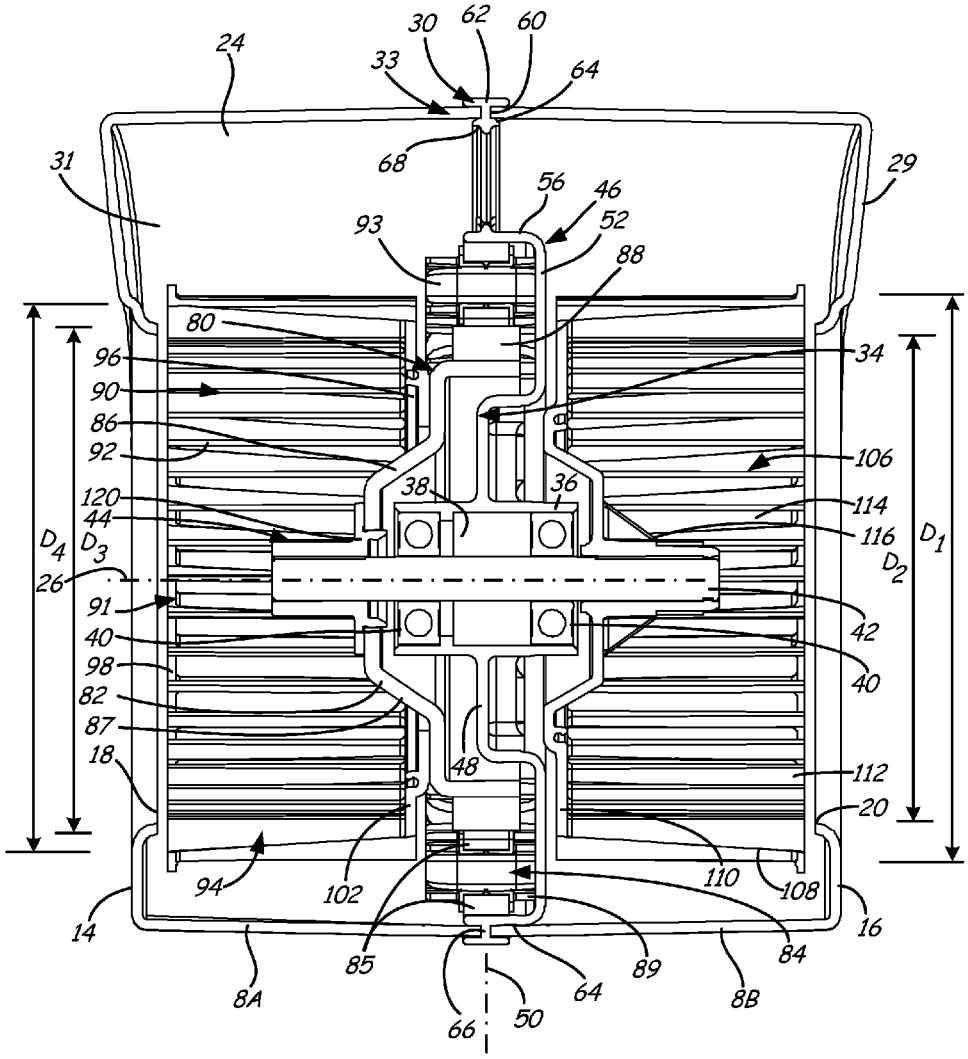
FIG. 4 is a cross-sectional elevational view of the blower illustrated in FIGS. 1-3.
Figure 5:
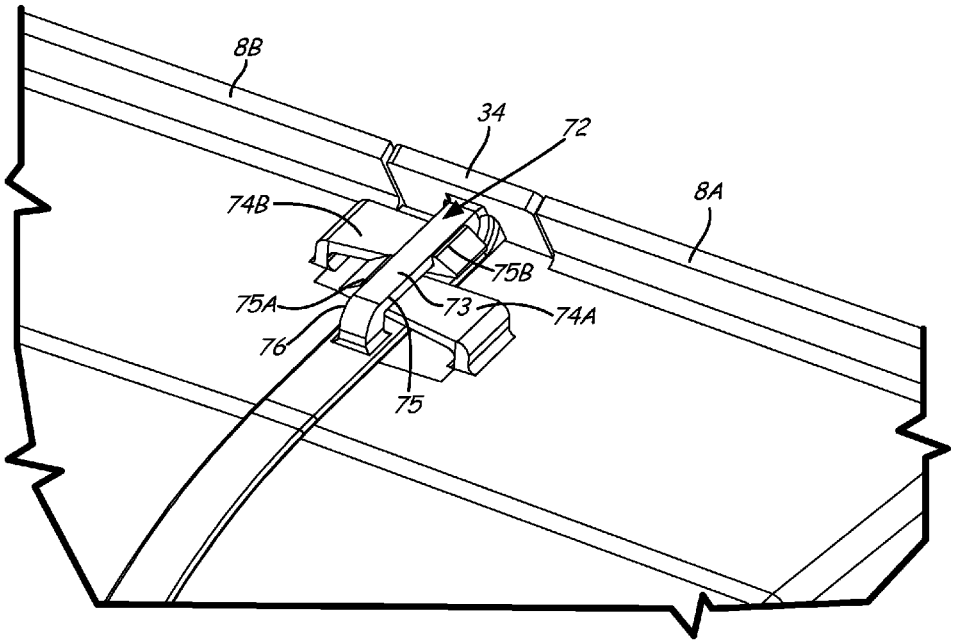
FIG. 5 is a perspective view of a portion of the blower illustrated in FIGS. 1-4.
Figure 6:
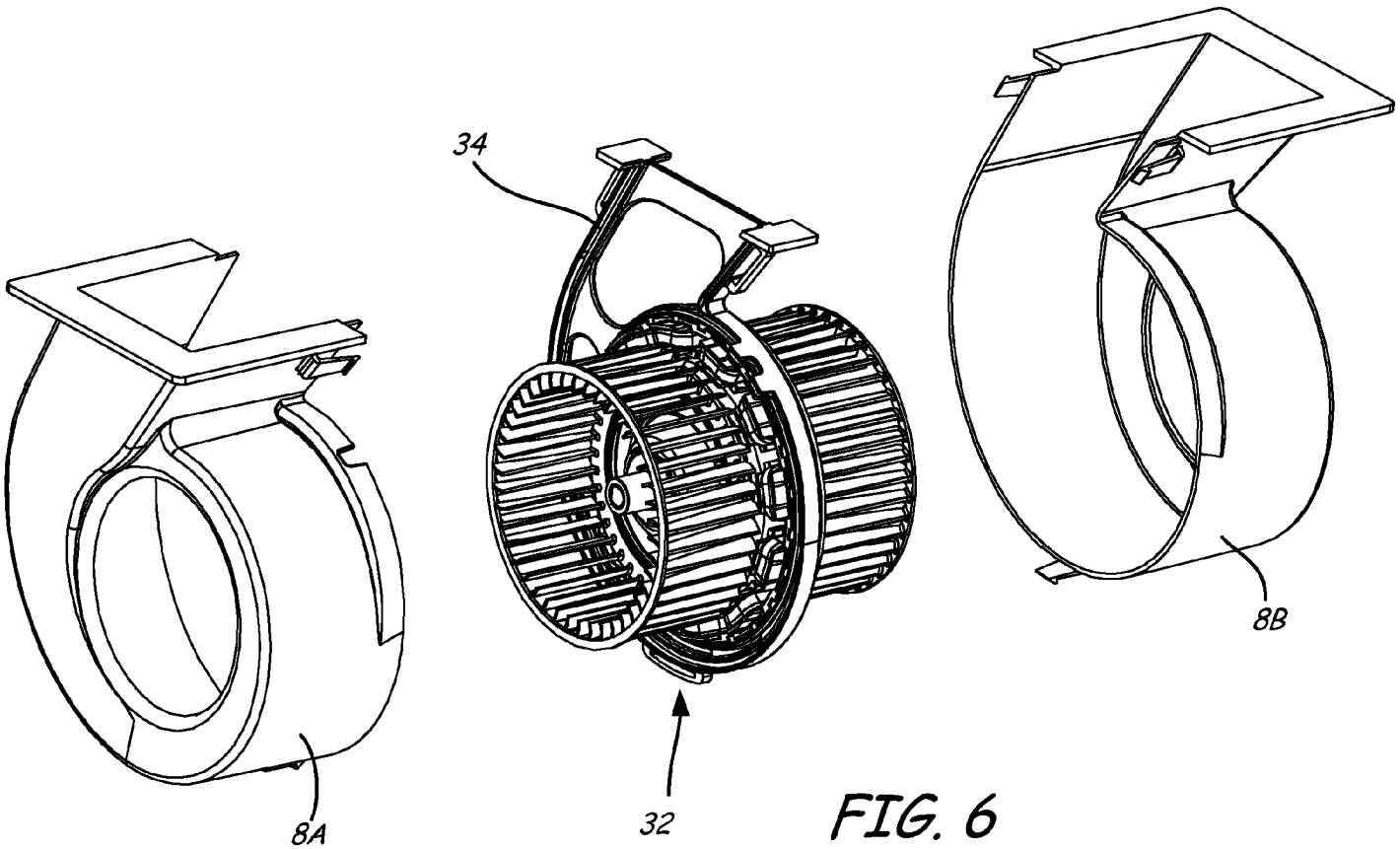
FIG. 6 is an exploded perspective view of the blower illustrated in FIGS. 1-5.
Figure 7B:
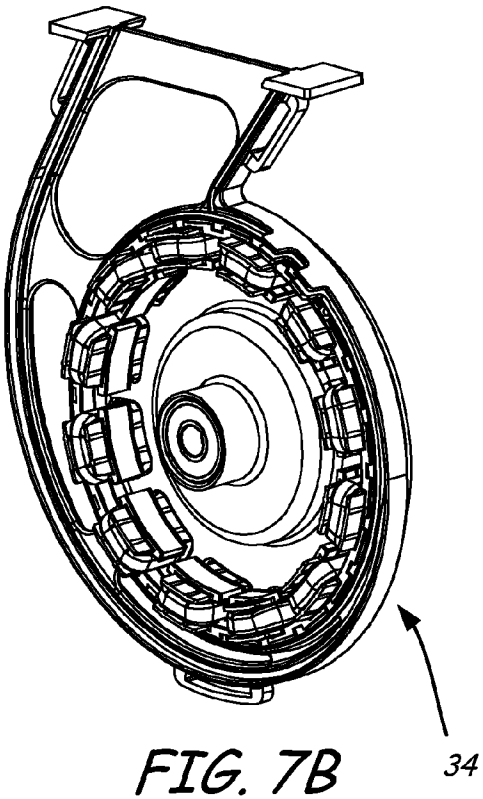
FIG. 7B is an assembled perspective schematic illustration of the components in FIG. 7A.
Figure 7A:
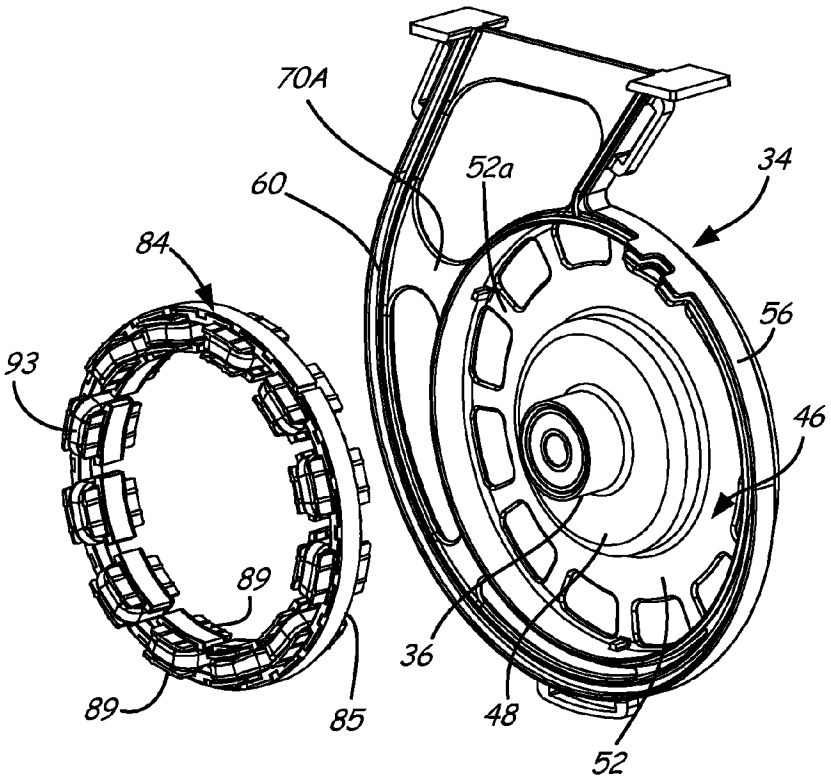
FIG. 7A is an exploded perspective schematic illustration of the frame and stator components of the blower illustrated in FIGS. 1-6.

Frame 34 further includes a housing mount portion 60 extending radially outwardly from upper brace portion 56 with a configuration suitable for securement of housing 12 thereto. Housing mount portion 60 may include an outer tab 62 and an inner surface 64 between which is defined a groove 66 that is sized and configured to receive housing 12. Inner surface 64 may comprise a surface of upper brace portion 56, or a surface of an inner tab 68 of housing mount portion 60. As best illustrated in FIG. 3, as a result of the scroll-shaped housing 12, a radius of housing mount portion 60 from blower axis 26 is not constant. Instead, a radius of housing mount portion 60 expands toward outlet 24 of housing 12 to accommodate the expanding scroll shape of housing 12. Frame 34 may therefore include a support portion 70 extending between upper brace portion 56 and housing mount portion 60. Support portion 70 may be a solid body, or a plurality of distinct support portion members 70A. It is contemplated that a series of distinct support portion members 70A may provide a weight savings, cost savings, and aerodynamic benefit over a continuous support portion 70 extending continuously between upper brace portion 56 and housing mount portion 60.

Housing mount portion 60 defines coupling location 30 at which housing 12 is secured to operating system 32. Preferably, operating system 32 is coupled with housing 12 only at coupling location 30. As will be described in greater detail hereinbelow, coupling location 30 is preferably disposed in a blower outlet portion 29 of housing 12 to minimize the aerodynamic impact of frame 34 in the operation of blower apparatus 10. In the illustrated embodiment, first and second housing sections 8A, 8B nest in respective grooves 66 of housing mount portion 60. In some embodiments, first and second housing sections 8A, 8B may be further secured to frame 34 at a locking cleat 72 of frame 34, wherein locking tabs 74A, 74B snappingly engage with locking cleat 72. Locking tabs 74A, 74B resiliently engage under an upper bar 73 of locking cleat 72, with a protrusion portion 75A, 75B of locking tabs 74A, 74B being urged through the resilience of locking tabs 74A, 74B into engagement with retention surfaces 75, 76 of locking cleat 72. In other embodiments, however, first and second housing sections 8A, 8B may be fastened, welded, soldered, or otherwise secured to one another and/or frame 34, as desired per application.

Operating system 32 further includes a motor 80 that includes hub 44, a rotor 82 that is rotatably driven about blower axis 26, and a stator 84. Rotor 82 may include a rotor core/backiron 86 with a rotor element 88 annularly arranged about hub 44. Rotor 82 may further include a first impeller portion 90 including impeller blades 92 for motivating air out from blower chamber 22 through air outlet 24. As illustrated, stator 84 may be annularly arranged radially outwardly about rotor element 88, which may compromise a magnet secured to rotor core 86.

In some embodiments, impeller blades 92 of impeller portion 90 extend in a substantially axial direction from rotor core 86, such that rotor core 86 forms a first impeller hub 87 to drive circumaxial motion of impeller blades 92 about blower axis 26, defined by rotor core 86 rotating with shaft 42 about blower axis 26. In such an embodiment, impeller portion 90 may be integrally formed with rotor 82, or may be secured directly thereto with fasteners, adhesives, weldments, or the like.

Impeller portion 90 may instead constitute a distinct first impeller 91 coupled to rotor 82 for rotation about blower axis 26. First impeller 91 may be secured to rotor 82 so as to rotate in unison with rotor 82 and shaft 42 about blower axis 26. First impeller 91 may comprise a first wheel 94 having an inner flange 96, an outer flange 98, and impeller blades 92 secured therebetween. In addition, first impeller 91 may include a coupling bracket 102 for securing first impeller 91 to rotor core 86 of rotor 82. Coupling bracket 102 may be secured to rotor core 86 through fasteners, adhesives, welds, or the like. First impeller 91 has a first diameter "$D_1$" that may be somewhat greater than first air inlet diameter "$D_2$" but may be substantially equal to a rotor diameter "$D_3$". It is contemplated by the present invention that rotor diameter $D_3$ may be somewhat greater or lesser than first diameter $D_1$ of first impeller 91. However, such variances are considered to be within the scope of the term "substantially equal", as used herein. In particular, the term "substantially equal", as used herein, is intended to mean within +/−15% difference between the two dimensions or properties being compared.

In the illustrated embodiment, motor 80 includes a second impeller 106 having a second wheel 108 having an inner flange 110, and outer flange 112, and second impeller blades 114 secured along a substantially axial direction between inner and outer flanges 110, 112. Second impeller 106 is preferably arranged for motivating air out from blower chamber 22 through air outlet 24, and may be secured to shaft 42 to be rotatably driven about blower axis 26 by the circumaxial rotation of rotor 82. Second impeller 106 may be secured to shaft 42 in a manner which provides rotation of second impeller 106 in unison with first impeller 91. Typically, such an arrangement is facilitated through respective couplings of first impeller 91 and second impeller 106 to shaft 42 to rotate in unison with shaft 42 about blower axis 26. Second impeller 106 may be secured to shaft 42 with a ring clamp 116 or other suitable fastening mechanism. As described above, first impeller 91 may be coupled to shaft 42 through its connection or integration with rotor 82. In the illustrated embodiment, rotor 82 is coupled to shaft 42 at a hub collar 120, which is itself fixedly secured to shaft 42.

One or more of first and second impellers 91, 106 may include forward-curved impeller blades 92, 114. The term "forward-curved" is understood in the art as an orientation of impeller blades 92, 114 that is distinguished from "radial" or "backward-curved" orientations. It has been found by the applicants that, at least in some embodiments, forward-curved impeller blades may provide aerodynamic advantages to the operation of blower apparatus 10.

First and second air inlets 18, 20 may be substantially axially aligned along blower axis 26, in that blower axis 26 extends through a radial centerpoint of substantially circular first and second air inlets 18, 20.

Motor 80 may be a brushless, direct-current electromagnetic motor in which rotor 82 is electromagnetically driven circumaxially about blower axis 26 by a stationary stator 84, as is understood in the art. In the present arrangement, however, stator 84 may be closely radially outwardly positioned with respect to rotor 82, and precisely secured to frame 34 in order to minimize necessary clearances as between the stationary stator 84 and the rotating rotor 82. Stator 84 may be pressed, glued, fastened, swaged, staked, and the like to stator support portion 46 of frame 34 annularly about magnetic rotor element 88 of rotor 82. Magnetic rotor element 88 may be bonded or fastened to rotor core 86 in a position that is substantially radially and annularly aligned with stator 84, such that stator 84 and rotor element 88 are annular rings annularly aligned with midplane 50. It is contemplated, however, that rotor element 88 and stator 84 may be somewhat axially displaced from one another, so as to not be precisely annularly aligned about hub 44. The arrangement of stator 84 and rotor element 88, however, is preferably suitable for efficiently driving the rotation of rotor 82.

Stator 84 includes a welded lamination stack 85 with molded insulators 89 and electrically conductive coils 93. Insulators 89 are secured between lamination stack 85 and coils 93, as is known in the art. Stator 84 is therefore compactly arranged circumaxially about blower axis 26 and in close radial outward proximity to magnetic rotor element 88.

In some embodiments, for example, an inner diameter $D_4$ of stator 84 may be substantially equal to first diameter $D_1$ of first impeller 91. Thus, each of first diameter $D_1$, an outer diameter of rotor element 88, and an inner diameter of stator 84 may be substantially equal to one another. Such an arrangement provides for a relatively compact motor 80 with minimized clearances and resultant high efficiencies. Moreover, motor 80 may be completely contained within the standard scroll-shaped housing 12, and yet provide enhanced motor output as a consequence of a relatively long leverage arm afforded by an enlarged diameter $D_1$, $D_3$, $D_4$ as compared to conventional motors located in the blower hub area. A particular arrangement provides for stator 84 concentrically arranged about rotor element 88.

An aspect of the present invention which enhances aerodynamic efficiency over conventional approaches is in locating the stator and the connection between the operating system and the housing downstream from the impeller. For the purposes hereof, the term "downstream" is intended to refer to the airflow progress through blower apparatus 10. In this regard, first and second air inlets 18, 20 are "upstream" from first and second impellers 91, 106, respectively. Airflow enters a respective first or second air inlet 18, 20 to encounter a respective first or second impeller 91, 106, so as to be directed into an outlet plenum 31 of housing 12, and ultimately out through air outlet 24. Consequently, those structures or components identified as being "downstream" of another structure or component is located in blower apparatus 10 in a position which is exposed to the cooling air subsequent to the comparison structure or component during the normal operation of blower apparatus 10. In this case, therefore, coupling location 30 is disposed at the portion of housing 12 defining outlet plenum 31, fluidly downstream from impellers 91, 106. In this manner, motor 80 of the present invention uses space within housing 12 that is far less sensitive to aerodynamic performance than configurations of the prior art. By limiting aerodynamic incursion, the arrangement of the present invention yields higher efficiencies and lower noise levels.

Electrical wiring 125 may be convenient located at blower housing, and need not extend through a hollow support shaft within the aerodynamic inlet portion. The leads of wiring 125 may therefore extend through an access 127 of housing 12, directly to motor 80.

The invention has been described herein in considerable detail in order to comply with the patent statutes, and to provide those skilled in the art with the information needed to apply the novel principles and to construct and use embodiments of the invention as required. However, it is to be understood that various modifications can be accomplished without departing from the scope of the invention itself.

What is claimed is:

1. A centrifugal blower apparatus, comprising:

a housing having first and second scroll-shaped sides separated by a main body portion defining an air outlet, said first side having a first air inlet, and said second side having a second air inlet wherein said first and second air inlets open to a blower chamber that is in fluid communication with said air outlet, said main body portion further defining a mid-portion axially substantially midway between said first and second sides;

an operating system having:

(a) a frame arranged in said blower chamber between said first and second sides, said frame having a central portion including a bearing housing;

(b) a first impeller for motivating air out from said blower chamber through said air outlet, said first impeller having a first outer diameter and said impeller having a hub and a central shaft extending from said hub, said central shaft being rotatable about bearings contained in said bearing housing of said frame; and (c) a motor for rotating said first impeller in a first circumaxial direction about a blower axis, said motor having a rotor with a second outer diameter that is substantially equal to said first outer diameter, said rotor being coupled to said first impeller circumaxially about said hub to rotate about said blower axis, and an annular stator arranged radially concentrically outwardly about said rotor, said annular stator having an inner diameter that is substantially equal to said first outer diameter, wherein said stator is secured to said frame within said blower chamber and said rotor is secured to said frame within said blower housing by way of said hub, central shaft and bearings; and wherein said operating system is coupled with said housing only at a coupling location downstream from said first impeller.

2. A centrifugal blower apparatus as in claim 1, wherein said first and second air inlets are substantially axially aligned along said blower axis.

3. A centrifugal blower apparatus as in claim 1, wherein said frame is disposed at said mid portion of said housing.

4. A centrifugal blower apparatus as in claim 1, including a second impeller for motivating air out from said blower chamber through said air outlet, said second impeller rotating in unison with said first impeller.

5. A centrifugal blower apparatus as in claim 4 wherein said second impeller is secured to said central shaft that is rotatably driven about said blower axis by said rotor.

6. A centrifugal blower apparatus as in claim 5 wherein said central shaft interconnects said first and second impellers.

7. A centrifugal blower apparatus as in claim 4 wherein said first and second impellers include forward-curved impeller blades.

8. A centrifugal blower apparatus as in claim 1 wherein said motor is a brushless, direct-current electromagnetic motor.

9. A centrifugal blower apparatus, comprising:

a housing having a first scroll-shaped side with a first air inlet, and a second scroll-shaped side with a second air inlet, said first and second air inlets open to a blower chamber that is in fluid communication with an air outlet of said housing;

an operating system having:

(a) a frame arranged in said blower chamber between said first and second sides; and (b) a motor secured to said frame, said motor including a shaft defining a blower axis, a rotor that is rotatably driven about said blower axis, and a stator, said rotor including a rotor core with a rotor element annularly arranged about said blower axis, and a first impeller portion having a first outer diameter, and including impeller blades for motivating air out from said blower chamber through said air outlet, said first impeller coupled to said rotor core and said shaft by way of a hub; said stator being annularly arranged radially concentrically outwardly about said rotor element, said stator having an inner diameter that is greater than said first outer diameter, and said rotor having a second outer diameter that is substantially equal to said first outer diameter;

wherein said operating system is coupled with said housing only at a coupling location downstream from said impeller portion.

10. A centrifugal blower apparatus as in claim 9 wherein said coupling location is substantially axially midway between said first and second sides of said housing.

11. A centrifugal blower apparatus as in claim 9 wherein said impeller blades extend from said rotor core.

12. A centrifugal blower apparatus as in claim 9, wherein said shaft is journaled in said hub for rotation about said blower axis.

13. A centrifugal blower apparatus as in claim 12, including a second impeller coupled to said shaft for rotation in unison with said first impeller portion to motivate air out from said blower chamber through said air outlet.

14. A centrifugal blower apparatus as in claim 13 wherein said impeller blades are forward-curved.

15. A centrifugal blower apparatus as in claim 9 wherein said first and second air inlets are substantially axially aligned along said blower axis.

16. A centrifugal blower apparatus as in claim 9 wherein said motor is a brushless, direct-current electromagnetic motor.

17. A centrifugal blower, comprising:

a housing having first and second scroll-shaped sides separated by a main body portion defining an air outlet, said first side having a first air inlet, and said second side having a second air inlet wherein said first and second air inlets open to a blower chamber that is in fluid communication with said air outlet, said housing further having a mid-portion axially substantially mid-way between said first and second sides;

a frame positioned within the mid-portion of said housing to internally support said housing, wherein said frame further divides said blower chamber and isolates said first inlet from said second inlet; said frame including a bearing housing having bearings aligned along a blower axis of said blower chamber;

a first impeller aligned within said blower chamber adjacent said first inlet, said impeller including spaced apart concentric blades defining an outer diameter of said first impeller;

a second impeller aligned within said blower chamber adjacent said second inlet, said second impeller including spaced apart concentric blades defining an outer diameter of said second impeller;

a shaft having a first end fixed to said first impeller and a second end fixed to said second impeller, wherein said shaft extends through said bearing housing and said shaft is coupled to said bearings;

a rotor having a rotor core and an annular rotor element, wherein said rotor core extends from said first impeller and wherein said annular rotor element has an outer circumference having a diameter substantially equal to said outer diameter of said first impeller; and an annular stator fixed to said frame wherein an inner circumference of said stator is arranged concentrically radially about said outer circumference of said rotor wherein an inner diameter of said annular stator is slightly larger than said outer diameter of said rotor.

18. A centrifugal blower apparatus as in claim 17, wherein said blades of said first impeller and said blades of said second impeller are forward-curved.

19. A centrifugal blower apparatus as in claim 17, wherein said rotor and stator, together, form portions of a brushless, direct-current electromagnetic motor.

20. A centrifugal blower apparatus as in claim 17, said rotor core extending from said first impeller at a hub of said first impeller.

* * * * *